US005373683A

United States Patent [19]

Kronseder

[11] Patent Number: 5,373,683

[45] Date of Patent: Dec. 20, 1994

[54] PROCESS AND DEVICE FOR FILLING AND SEALING OF CONTAINERS

[76] Inventor: Hermann Kronseder, Regensburger Strasse 42, 8404 Woerth/Donau, Germany

[21] Appl. No.: 938,167

[22] PCT Filed: May 28, 1991

[86] PCT No.: PCT/EP91/00982

§ 371 Date: Dec. 4, 1992

§ 102(e) Date: Dec. 4, 1992

[87] PCT Pub. No.: WO91/18824

PCT Pub. Date: Dec. 12, 1991

[30] Foreign Application Priority Data

Jun. 6, 1990 [DE] Germany ..... 4018121
Sep. 29, 1990 [DE] Germany ..... 4030928
Nov. 14, 1990 [DE] Germany ..... 4036306

[51] Int. Cl.[5] ..... B65B 3/00; B65B 7/28; B67B 3/02; B67B 3/064

[52] U.S. Cl. ..... 53/471; 53/267; 53/281; 53/304; 53/314

[58] Field of Search ..... 53/471, 486, 487, 488, 53/141, 304, 314, 317, 282, 281, 290, 297, 359, 341, 331, 267, 268

[56] References Cited

U.S. PATENT DOCUMENTS 2,361,366 10/1944 Bell ..... 53/314 X
2,655,302 10/1953 Hohl et al. ..... 53/317 X
2,695,743 11/1954 Wetherby-Williams .
3,098,334 7/1963 Barnby et al. ..... 53/488 X
3,273,303 9/1966 Hill ..... 53/488
3,364,652 1/1968 Groth et al. ..... 53/282
3,759,012 9/1973 Pagay .
3,793,800 2/1974 Sexton ..... 53/341
3,842,574 10/1974 Dickey ..... 53/488
3,874,147 4/1975 Zetterberg ..... 53/314
3,986,323 10/1976 Aidlin et al. ..... 53/313
4,308,707 1/1982 Willingham ..... 53/314
4,628,669 12/1986 Herron et al. ..... 53/488 X

FOREIGN PATENT DOCUMENTS 78217 5/1962 France .
1432416 11/1968 Germany .
2042328 6/1971 Germany .
2253985 5/1973 Germany .
2313268 9/1973 Germany .
996352 6/1965 United Kingdom .

*Primary Examiner*—Horace M. Culver
*Attorney, Agent, or Firm*—Finnegan, Henderson, Farabow, Garrett & Dunner

[57] ABSTRACT

The invention relates to an improved process for the filling and closing of vessels, preferably of bottles with a liquid, in which vessels filled in a filling means are closed with a closure element with the deformation of the closure element or/and the vessel and with the formation of a sealing press fit between the vessel and the closure element and a device for carrying out the process. The process according to the invention is characterized in that the closure element is affixed with a low sealing pressing pressure to form a sealing press fit in a first closing phase and the final sealing pressing pressure is produced in a second closing phase.

55 Claims, 11 Drawing Sheets

PROCESS AND DEVICE FOR FILLING AND SEALING OF CONTAINERS

The invention relates to a process for the filling and closing of vessels, preferably of bottles with a liquid, in which vessels filled in a filling means are closed with a closure element with deformation of the closure element or/and of the vessel and with the formation of a sealing press fit between the closure element and the vessel and a device for the carrying out of the process, the device comprising accordingly a filling means for the filling of the vessel and a closure means for closing of the vessel with a closure element.

Such processes and corresponding devices are used in the beverage industry for filling and closing bottles, a so-called crown cap being mostly used at the closure element. In order to ensure a long-term preservability of the filled beverages, high requirements must be met by the tightness of the closure. Accordingly, a high sealing pressing pressure is necessary between the crown cap and the bottle to be closed. This high sealing pressure is achieved by pressing the crown cap with a great force, e.g. 80 kp, against the opening edge of the bottle in the closure device, and a deformation of the crown edge of the crown cap is effected in such fashion that the crown cap is fixed to the bottle in the pressed position. Accordingly, the construction of the closure means must be designed in such a fashion that correspondingly high pressing pressures can be produced. Restrictions result from this requirement with respect to the minimally achievable dimensions of the closure device, and in particular the minimally achievable overall height.

Consequently, the closing process within the closure device can only be carried out at a relative distance from the filling means due to the large dimensions of conventional devices for the filling and closing of vessels, the result of this being that the filled bottles remain open over a relatively long period of time, and the liquid contained therein is exposed to the ambient air. The influence of the ambient air can substantially impair the long-term preservability and the taste of a filled beverage.

Therefore it is desired to provide closure devices which can be installed as near to the filling means as possible or which can be integrated in the filling means so that the closing of the vessels can be carried out as soon after the filling as possible. Such closure means are described in the publications DE-AS 20 42 328, DE-PS 23 13 268, DE-PS 22 53 985, U.S. Pat. Nos. 3,759,012 and 2,695,743. There is the disadvantage in the case of an integration of the closure means in the filling means that, in the case of a bottle breaking (due to high closure pressures), considerable disturbances of the operating sequence occur.

It is known from DE-OS 14 32 416 to first of all only place closure elements consisting of flat lids on the vessel openings for covering the vessel openings directly after the filling and to feed the vessels with the loosely placed lids to a closure means. There is the risk, in particular at high working speeds, that the loosely placed lids can slip down and off of the vessels.

It is the object of the invention to provide a process of the type mentioned at the beginning, in which a higher quality and, in particular, long-term preservability of the filled products result as compared with known processes and a device for carrying out the process, no increased constructional expenditure for reducing the closure means or for its integration in the filling means being necessary.

The process according to the invention is characterized in that the closure element (21) is affixed in a first closing phase to form a slight sealing press fit and a sealing press fit is produced in a second closing phase with the final sealing pressing pressure. Accordingly, the closure means of the device according to the invention comprises a first means for affixing the closure element to the vessel with the formation of a slight sealing press fit and a second means for producing a sealing press fit with the final sealing pressing pressure.

It can be achieved by this solution according to the invention that the vessels can be closed by the first means in such fashion that the liquid contained therein is no longer subjected to the ambient atmosphere while the vessels are fed to the second means for the final closing.

Thus, the second means can be installed at a distance from the filling means, and there are no restrictions as regards its overall height. The first means only provided for affixing only requires a small overall height and can thus be advantageously installed directly at the vessel outlet of the filling means. By keeping the ambient atmosphere away from the liquid between the filling and the final closing of the vessels, there is no impairment of the quality of the liquid such as of the taste and the long-term preservability of a filled beverage. It is ensured by the slight press fit produced in the first closing phase during the filling of e.g. carbonated beverages that the carbon dioxide can escape from the bottles, and there is not the risk, as in closure lids which are only placed on the bottles, that the closure elements are lifted by the emerging carbon dioxide from the vessel opening and can fall off.

In an advantageous development of the invention, the closure element, preferably a crown cap, can be preshaped in suitable fashion by a snap or lock fit for the producing of a slight sealing press fit in the first closing phase. However, it is also possible to plastically deform the closure elements directly during the first closing phase for producing the slight press fit.

In a preferred embodiment, the filling means is designed as a carousel filling means, and the first means for the first closing phase comprises an affixing means for the first closing phase comprises an affixing means with supports for the closure elements, which engages into the base circle of the carousel filling means at the vessel outlet. The affixing is carried out in such fashion that the vessels disposed in the carousel filling means on elevating tables below filling valves, which can be pressed against the filling valves by means of the elevating tables, are pressed by means of the elevating tables from below against the closure elements held in the supports of the affixing means, the vessels having been lowered in advance with respect to the filling valves to such an extent that the affixing means can engage into the interstice between the vessel and the filling valve. The vessels with the affixed closure elements are then transferred to a transport means designed as rotary disk at the outlet of the filling means, by means of which the vessels can be supplied to a second means, disposed at a distance from the filling means on a transport orbit for the final closing of the vessels.

It is provided in one possibility that the affixing head comprises at least three pin elements which are shaped with a seat cross-section substantially tapered in accordance with the shape of the crown cap edge at the end facing the crown cap edge for the formation of a seat aligning the crown cap for affixing.

It is achieved by this development that the crown cap is held on the affixing head in a defined position so that if the affixing head and the vessel to be closed have been brought into the closing position, an exact alignment between crown cap and vessel is ensured. In the affixing head known from the prior art, an exact alignment of the crown caps on the affixing head is very difficult.

In the affixing head designed in this fashion the crown cap must not directly rest against a magnetic support. Instead of an affixing head which yields during the affixing, the magnetic support can be disposed in rearward staggered fashion with respect to the seat position of the crown cap.

In the case of the use of three pins it is ensured that the crown cap rests against respectively one pin at three points, and thus a non-tilting, centered seat is ensured.

A deformation of the crown cap edge which is especially suited for affixing the crown cap is attained, since it is provided in a further advantageous development of the invention that the pins are undercut in their portion adjoining the cone end and are in particularly conically tapered.

A guide path can be provided below the revolving affixing heads to supply the crown caps to the affixing heads. Crown caps introduced into this guide path from a storage container can either be received by a movable affixing head being lowered towards the crown cap or the crown caps are supplied to an affixing head which comprises a deformation pin with an extension which serves as a carrier for the crown cap in the guide path. The crown cap is pushed onto an oblique ramp by the carrier and lifted into the area of action of the magnetic support.

It is provided in a further advantageous development of the invention a pneumatic driving means for the affixing head. It is ensured by this solution that the affixing process can be carried out at an extraordinarily high speed with sufficient pressing pressure so that little time is required for affixing the crown caps.

It is advantageous if the driving means comprises at least a pressure cylinder with a piston guided therein. Affixing heads revolving in the fashion of a carousel are preferably provided, to which a pressure cylinder with piston is in each case allocated and which are movable for the affixing of the crown caps into the bottle conveyor path of the filling means, preferably a carousel filling means, so that they intersect or are tangent to the conveyor path. Due to the high speed of the affixing process which can be attained according to the invention, the affixing heads must only be aligned to the bottle openings over a very short path section, and no reduction of the bottle conveying speed is required for carrying out the affixing process.

The pressure cylinders allocated to the revolving affixing heads are preferably connected to a disk cam comprising passage ducts for the pressure gas which are connectable to the pressure gas source via a sliding block with a pressure gas feed duct opening towards a sealing slide surface, whose opening end can be covered by the disk cam with abutment against the sealing slide surface and can be connected with the opening ends of the passage duct, which do not face the pressure cylinders.

The cross-sectional surfaces of each passage duct and the cross-sectional surface of the pressure gas supply duct are advantageously dimensioned at least at their opening ends, which can be connected with each other, in accordance with a desired time sequence of the affixing process.

The cross-section of the pressure gas supply duct is suitably smaller than the cross-section of the passage duct at least at the outlet opening facing the disk cam. Due to this, the sealing of the pressure gas supply duct against the disk cam is facilitated With the given dimensions, if no connection to a passage duct is established, since the sealing slide surface is large as compared with the outlet opening of the pressure gas supply duct in the sliding block.

In a further advantageous development of the invention the sliding block is connected with a piston guided in a pressure cylinder, the end of the pressure gas supply duct not facing the disk cam ending in the interior of the cylinder. An auxiliary spring can additionally act on the piston for the optimum control of the pressing force of the sealing surfaces against the disk cam.

The invention will now be explained and described in greater detail by means of examples of embodiment and the enclosed drawings relating to these examples of embodiment.

Figure 1:
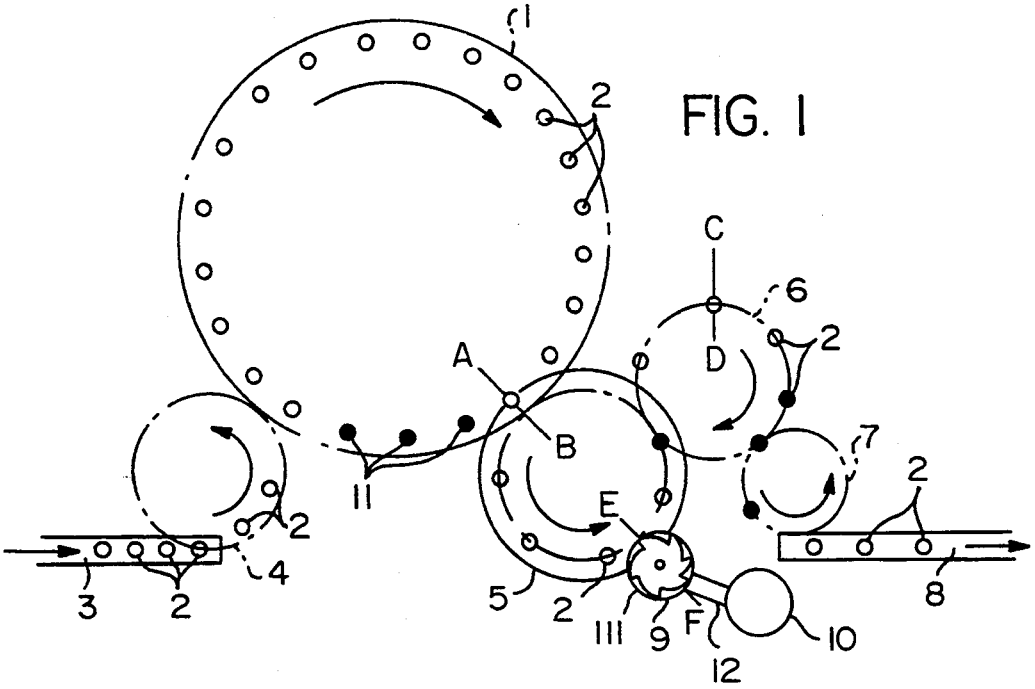
FIG. 1 shows schematically an embodiment of a device according to the invention.

A filing means is designated with the reference numeral 1 in FIG. 1, which is designed as a carousel filling means in the present embodiment. Vessels, in the present case, bottles, are disposed on elevating tables 11 provided in distributed fashion around the circular circumference of the filling means, which vessels can be pressed with their filling openings against filling valves disposed above the elevating tables (not shown in FIG. 1) by means of the elevating tables. Bottles are fed to the carousel filling means 1 via an inlet system, the inlet system comprising an inlet belt 3 and a rotary transport disk 4, the bottles 2 being transferred to the rotary transport disk 4 from the inlet belt 3, which conveys them to the filling means 1. Another rotary transport disk designated 5 is provided, to which the filled bottles are transferred at the outlet of the filling means and which conveys them to a further rotary transport disk 6. An affixing means (not shown in FIG. 1) for affixing crown caps with a slight press fit to the bottles filled during a revolution in the carousel filling means is provided at the point of intersection designed with the line A-B. A closing means (not shown in FIG. 1) for the final closing of the bottles with further deformation of the affixed crown caps is disposed peripherally of the path of the rotary transport disk 6 at the point designated with the line C-D. The completely closed bottles finally get into an outlet system which comprises a rotary transport disk 7 to which the closed bottles are transferred from the rotary transport disk 6 and which conveys them to an outlet belt 8. A feeding means for crown caps is designated 9, which means feeds the crown caps from a storage reservoir 10 via a guide 12 and a deformation means 111, which will be described more below specifically with reference to FIG. 13, to the affixing means (not shown in FIG. 1). The affixing means comprises a rotary disk 13 coaxial with rotary transport disk 5, having supports disposed on the circumference thereof for the crown caps fed via the feeding means.

Figure 2:
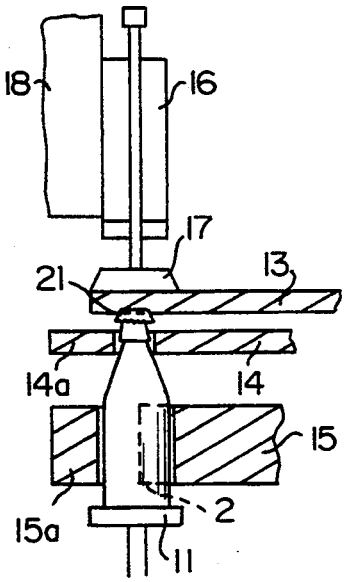
FIG. 2 shows an embodiment of a means according to the invention for the affixing of crown caps in a first closing phase.

Details of this rotary disk 13 of the affixing means are shown in FIG. 2. As is shown in FIG. 2, the rotary disk 5 comprises an upper guide element 14 and a lower guide element 15, the guide elements comprising guide slots at the periphery of the elements into which the bottles to be transported can be introduced. Guide arcs are respectively designated with 14*a* and 15*a*, by means of which the bottles are held in the guide slots. As shown in FIG. 2, the rotary disk 13, the upper guide element 14 and the lower guide element 15 intersect with the path of travel of the filling means, where the elevating tables 11 supporting the bottles are disposed. A filling valve 16 connected with a filler tank 18, is respectively disposed above each elevating table 11 and rotates with it, which valve has a centering bell 17 at its lower end.

During the filling process the bottles 2 are pressed in each case against a centering bell by an elevating table 11. The position of the bottle at the outlet of the filling means is shown in FIG. 2, in which the bottles are completely filled and lowered with respect to centering bells 17 by lowering the elevating tables 11. The rotary disk 13 enters into the space between the centering bell 17 and the upper end of the bottle 2, on which crown caps are held at predetermined points by means of a magnet, at least in the present embodiment. At the point at which a crown cap on the rotary disk 13 is aligned with the opening of the bottle 2, the elevating table 11 is moved upwards, and the bottle is pressed into the crown cap with an elevating force of about 20 kp in the present example for affixing the cap. In order to ensure such an affixing, the cap is preshaped in suitable fashion. Suitable pre-shapings will be explained more exactly in the following by means of FIGS. 5 to 14. Since the guide path of the crown cap and the guide path of the elevating tables 11 do not correspond to each other, wear phenomena occur at the affixing point. By means of additional guide means (not shown in FIG. 2) the guide paths can be caused to match during the affixing process avoiding such a wear by ensuring, e.g. by a suitable guide rail, that the path of the bottle is adapted to the path of the crown cap during the affixing process.

It is especially advantageous if the diameter of the rotary disk 13 is smaller than that of the rotary disk 5 or of the guide elements 14 and 15, and its axis of rotation is disposed ecentrically with respect to that of the guide elements 14, 15 in such fashion that the indexing circles of the filling carousel, the guide elements 14 and 15 and the rotary disk 13 overlap each other at the point designated with the line A-B in FIG. 1. Due to this, a bottle can be kept axially clamped between a centering bell 17 and an elevating table 11 until it has safely entered the guide elements 14, 15, after which the centering bell 17 is lifted or the elevating table is lowered so that the rotary disk 13 can enter between the bottle head and the filling valve for the delivery of a cap. It is furthermore advantageous to drive the rotary disk 13 with a cylindrical lantern gear which is connected to its top and which meshes with the guide rods of the centering bells 17 at the filling carousel, whereby an extremely exact synchronism of the affixing of the cap on the bottle is attained, which is of advantage for centering accuracy.

Figure 3:
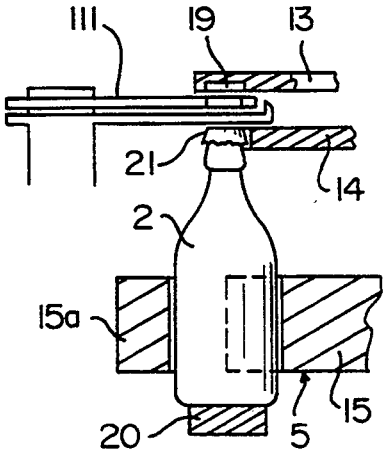
FIG. 3 shows a means for supplying caps to the affixing means of FIG. 2.

FIG. 3 shows how the crown caps are fed to the rotary disk 13 by the feeding means comprising a deformation means 111. Crown caps arriving at the outlet of the deformation means 111 are introduced into a recess 19 in the rotary disk by attracting the crown caps via magnetic forces acting on the support point near the recess 19. A bottle 2 transported on a sliding sheet 20 by the rotary disk 5 is shown in FIG. 3, whose crown cap 21 is already affixed. The rotary disk 13 conveys the crown cap over to the affixing point with the bottle in the same direction of rotation with which the rotary disk comprising the upper guide element 14 and the lower guide element 15 transports the bottle 2.

The bottle 2 with an affixed crown cap 21 is then conveyed by the rotary disk 5 for transfer to the rotary disk 6, where the means for the final closing of the bottle is disposed.

Figure 4:
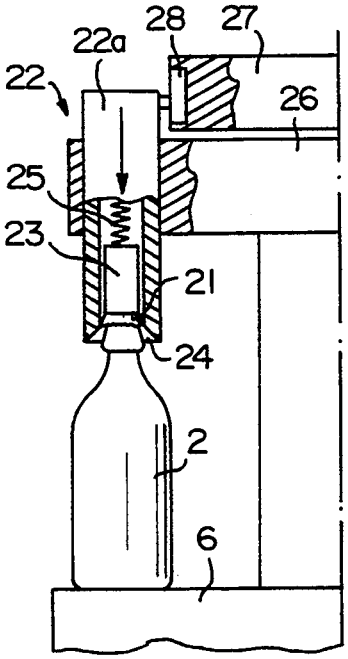
FIG. 4 shows a means for the final closing of a bottle with an affixed crown cap according to the invention.

The means used for the final closing of the bottles is shown in FIG. 4. The reference numeral 22 designates in FIG. 4 a closure device for the final closing of a bottle with an affixed crown cap, the closure device being formed by a sleeve 22*a*, in which a holding-down means 23 which is cushioned against the closure device by a spring 25 is disposed. The sleeve of the closure device 22 has a closure cone 24 at its lower end. The closure device is guided in a rotating bearing plate 26 and includes a wheel or a cam 28 which engages into a recess of a stationary lifting cam 27.

Due to its being guided in the rotating plate 26, the closure device 22 can follow the path of the bottle 2 as it is moved by the rotary transport disk 6. The closure device 22 is moved downwards for the closing as the wheel 28 engaging with a lifting cam lowers the closure device 22 in accordance with the cam profile. In the present example a force of about 80 kp is exerted on the crown cap by the holding-down means 23, this force being active prior to and during the pressing down of the closing cone 24 for flanging the crown edge of the crown cap by the sleeve 22*a*.

Figure 5:
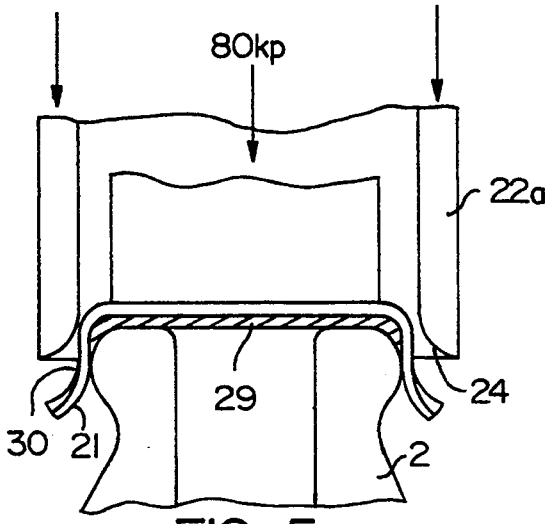
FIG. 5 shows a crown cap affixed to a bottle according to the invention in a means for the final closing of the bottle.
Figure 6:
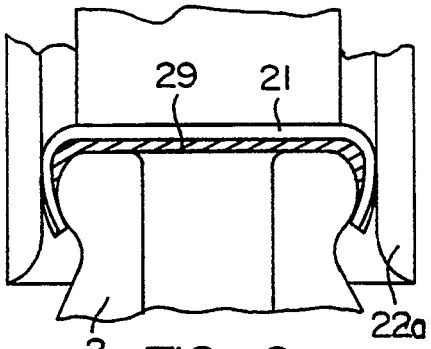
FIG. 6 shows a crown cap on a bottle after the final closing of the bottle.

The condition of the cap directly prior to the final closing of the bottle 2 is shown in FIG. 5. The crown cap 21 affixed to the bottle 2 with a sealing insert 29 is connected with the bottle 2 by a lock fit active in the area 30 of the crown edge of the crown cap. The sealing pressing pressure necessary for the final closing is produced by the holding-down means, in the present embodiment 80 kp of the sealing pressing pressure necessary for the final closure, and the crown cap is flanged by the sleeve 22*a* of the lowered closure device as shown in FIG. 6. Due to the flanging, the pressing pressure produced by the holding-down means is substantially preserved, and the bottle is sealed gas-tightly.

Figure 7:
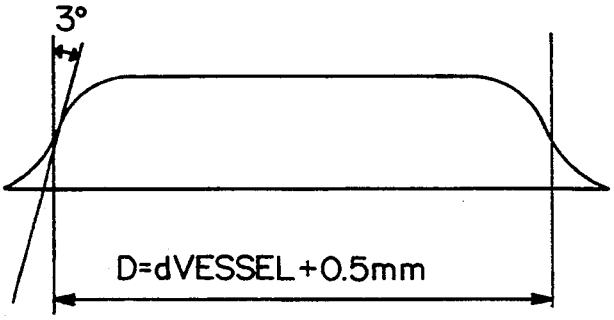
FIG. 7 shows a crown cap as it has been used so far for the closing of bottles in one operation.
Figure 8:
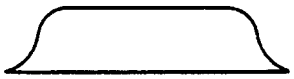
FIG. 8 shows a first example of a preshaped crown cap as it can be used in a device according to the invention for the closing of bottles in two phases.

FIG. 7 shows a crown cap as it is conventionally used for the closing of bottles. The crown edge of the crown cap has an inclination of about 3% in the center of the width, and the inner diameter D of the crown cap exceeds the outer diameter d of the bottle to be closed by about 0.5 mm in the center of the crown edge. A crown closure suitably preshaped for use in the process of the invention is shown in FIG. 8. As is shown in FIG. 8, the crown edge is not inclined in the center with respect to a direction vertical to the base portion of the crown cap, and the inner diameter of the crown cap is by about 0.1 mm smaller than the outer diameter of the bottle to be closed approximately in the middle of the crown edge. Such a crown cap can be affixed in the fashion described in FIG. 2 forcing a snap or lock fit between the crown cap and the bottle to be closed in the first closing phase of the bottle.

Figure 9:
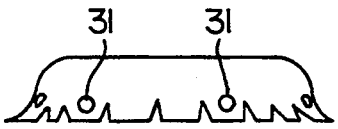
FIG. 9 shows a second example of a crown cap usable in a device according to the invention.

A further preformed crown cap suitable for affixing to a bottle is shown in FIG. 9. Recesses 31 are pressed into the crown edge of the crown cap by means of which inwardly projecting dents are formed. Due to these inwardly projecting dents, the cap can be affixed to a bottle forming a snap or lock fit.

Figure 10:
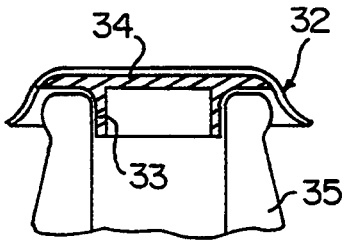
FIG. 10 shows a third example of a crown cap usable in a device according to the invention.

A further crown cap affixable in the first closing phase is shown in FIG. 10. The crown cap 32 comprises a sealing insert 34 with a central lug 33. A snap or lock fit can be produced between the central lug 33 and the inner edge of the opening of a bottle 35, whereby the crown cap 32 can be affixed to the bottle 35 in the first closing phase.

Figure 11:
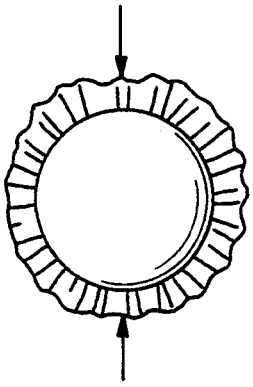
FIG. 11 shows a fourth example of a crown cap usable in a device according to the invention.

A further possibility for a suitable deformation of a conventional crown cap is shown in FIG. 11. The crown cap is crimped at opposite points of the crown edge. A crimping could also be effected at further, preferably opposite points.

Figure 12:
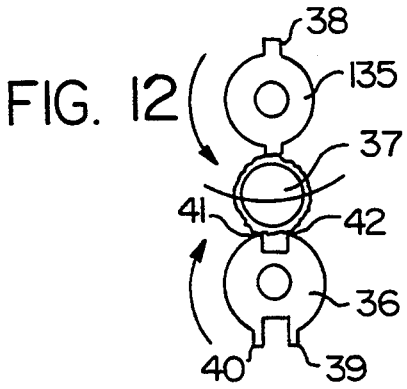
FIG. 12 shows schematically a device for re-shaping a conventional crown cap to a crown cap usable in the process according to the invention.

A device is schematically shown in FIG. 12, with which such indentations can be produced. For deformation, a crown cap 37 is guided through opposite deformation rollers 135 and 36 rotating in opposite directions of rotation, the deformation rollers having deformation cams 38 to 42 by means of which the crown edge of the crown cap can be crimped in the fashion explained by means of FIG. 11, a preshaped crown cap with three indentations being produced in the present case.

Figure 13:
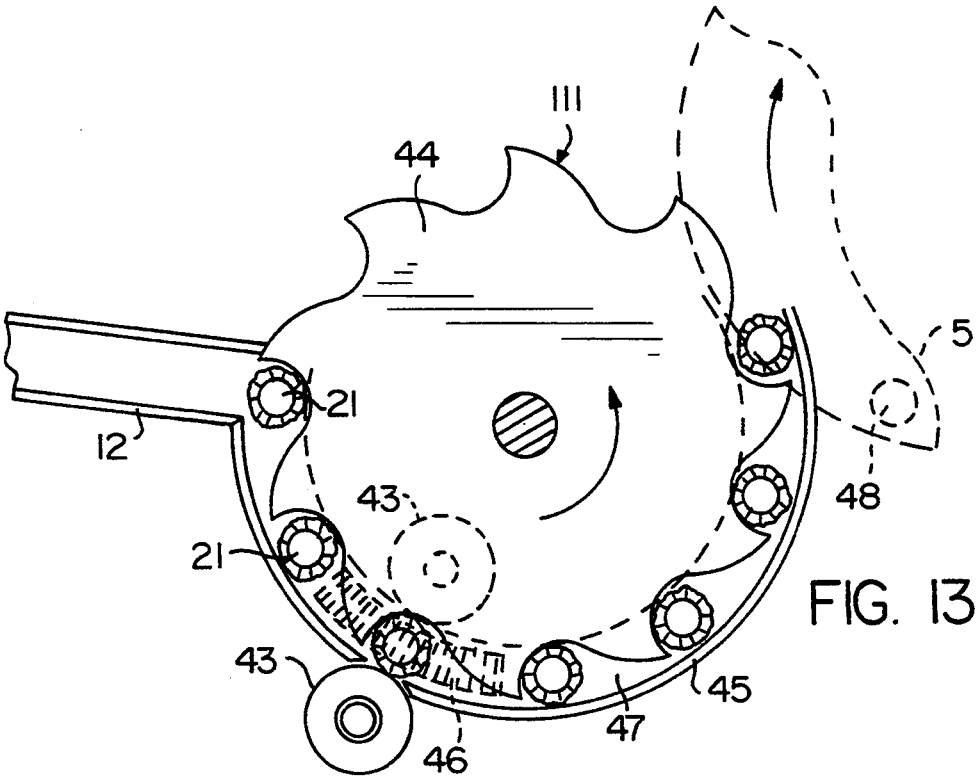
FIG. 13 shows a second device for reshaping a conventional crown cap to a crown cap usable in the process according to the invention.

A means is shown in FIG. 13 for reshaping a conventional crown cap to a crown cap according to FIG. 11. Such a reshaping means can be included in the feeding means shown in FIG. 1 where it is designated with the reference numeral 111. The crown caps are fed via the guide 12 and guided between two deformation wheels 43 by a rotary disk 44 comprising peripheral carrier slots, which are laterally closed by a guide arc 45 in the transport area of the carrier plate, a lateral indentation of the crown caps being carried out. A holding-down rail, designated 46, makes an exact guiding of the crown cap on a crown cap support 47 possible during deformation. A magnetic support, designated 48 in FIG. 13, is disposed on the rotary disk 5, to which the preshaped crown caps are transferred.

Figure 14:
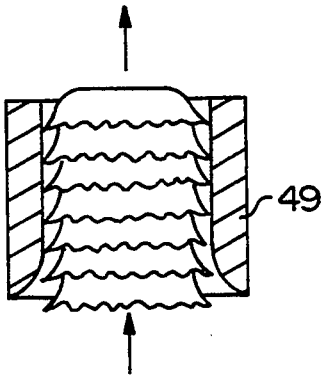
FIG. 14 shows schematically a further example of a device for the re-shaping of a conventional crown cap to a crown cap usable in the process according to the invention.

Another device by means of which the crown caps can be produced in similar fashion as in the example shown in FIG. 8, is shown in FIG. 14. The inner diameter of the crown caps is uniformly narrowed by pressing the crown caps through a sleeve 49 which has a correspondingly suitable inner diameter.

Figure 15:
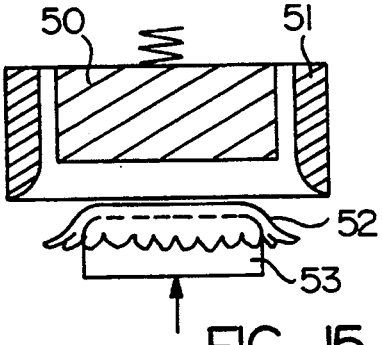
FIG. 15 shows an affixing means for affixing a crown cap to a bottle according to the invention with plastic deformation of the crown cap.

An affixing process is shown in FIG. 15, which is similar to the described process for the final closing of the bottles. A bottle 53 with a conventional crown cap 52 placed on top of it is pressed against a holding-down means 50 which is disposed in a deformation sleeve 51. The difference with the closing process for the final closing of the bottles which is shown in FIG. 4, is that the inner diameter of the deformation sleeve 51 is selected in such a manner that only a slight press fit is produced between the bottle 53 and the crown cap 52.

Figure 16:
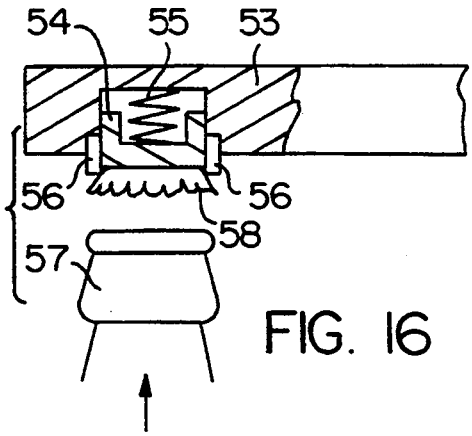
FIG. 16 shows a further example of a means for affixing a crown cap to a bottle according to the invention with plastic deformation of the crown cap in a position prior to the affixing.
Figure 17:
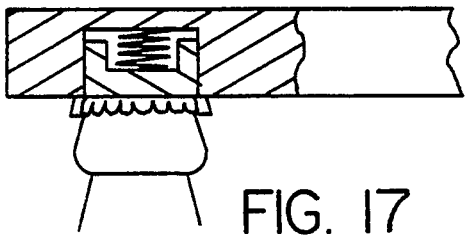
FIG. 17 shows the means of FIG. 16 in a position during affixing.

FIGS. 16 and 17 show that the affixing of the cap can also be carried out by pressing a bottle 57 against a conventional crown cap held by a magnetic support 54, lateral deformation pins 56 flanging the crown edge of the crown cap 58 in places and producing thereby a lock fit of the cap on the bottle. In the embodiment shown, the magnetic support 54 is connected to a rotary disk 53 via a spring 55 which corresponds to the rotary disk 13 shown in FIGS. 2 and 3.

The deformation means included in the device in the present embodiment can also be provided separately from the device.

Embodiments having affixing heads with at least three pins will be described in the following by means of FIGS. 18 to 25.

Figure 18:
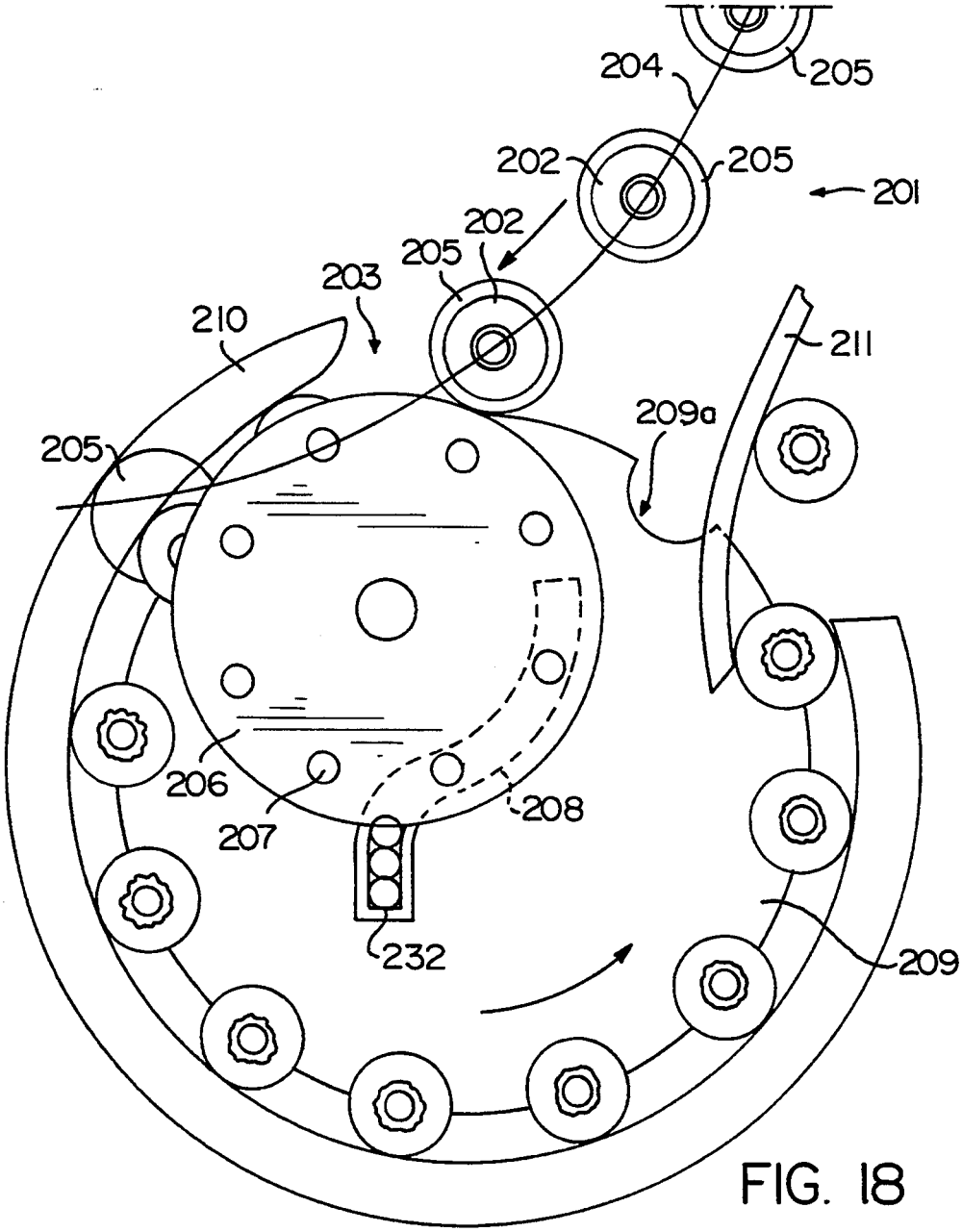
FIG. 18 shows an example of a device according to the invention for the filling and closing of vessels.

A carousel filling means is designated in general with the reference numeral 201 in FIG. 18, a marginal detail of which is represented in FIG. 18. Elevating tables 205 are disposed on the circular conveyor path designated 204 in the carousel filling means, on which bottles 202 to be filled are placed. The bottles can be pressed by the elevating tables 205 within the filling means 201 against filling valves (not shown in FIG. 18). An affixing means is designated in general 203, which affixing means comprises a rotary disk 206. Affixing heads are disposed on the rotary disk 206 on its circular circumference, of which magnetic plates 207 inserted into the rotary disk 206 are shown in FIG. 18. The rotary disk 206 with the affixing heads engages in such fashion into the conveyor path 204 of the filling means so that the paths of the bottles conveyed on the elevating tables 205 of the carousel filling means 201 and the paths of the affixing heads rotated by the rotary disk 206, intersect each other in an area, in which an affixing of the crown caps can be carried out. A guide path designated 208 is provided by means of which the crown caps can be guided laterally below the rotary disk 206 and then under the rotary disk for a distance along the revolving path of the affixing heads. The feed of crown caps to the affixing heads via this guide path 208 will be explained in greater detail in the following by means of FIG. 19.

A further rotary disk designated 209 is provided having recess pockets 209*a* on its disk edge for the bottles 202. A lateral bottle guide designed 210 engages in the conveyor path 204 of the carousel filling means like the rotary disk 209 with its pockets 209*a*, and is stationary with respect to the carousel filling means, the rotary disk 209 and also the rotary disk 206. A further lateral bottle guide designated 211 engages into the revolving path of the bottles in the rotary disk 209 and feeds the bottles to a means (not shown in FIG. 18) for the final closing. Driving means for the rotary disk 206 and the rotary disk 209 and synchronizing means for synchronizing the rotation of the rotary disk 206 and the rotary disk 209 with the rotation of the carousel filling means are also not shown in FIG. 18.

Figure 19:
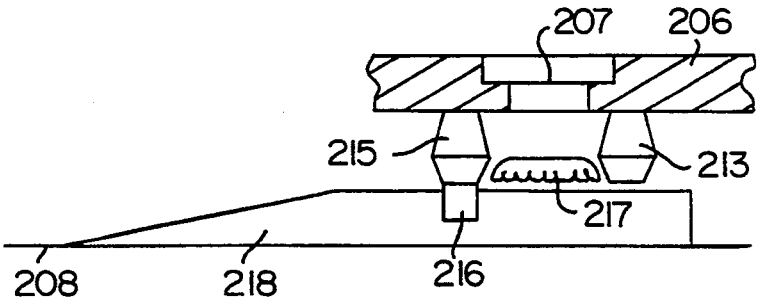
FIG. 19 is a lateral view of an embodiment of an affixing head according to the invention.
Figure 20:
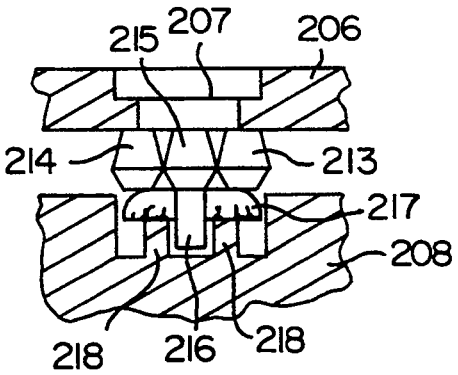
FIG. 20 is a rear view of the embodiment of FIG. 19.
Figure 21:
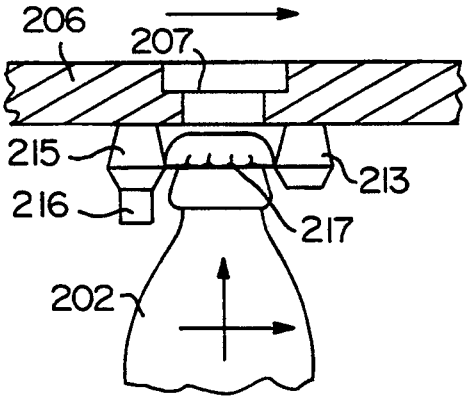
FIG. 21 is a lateral view of the embodiment according to FIGS. 19 and 20 during the affixing of the crown cap.

An affixing head as shown in FIGS. 19 to 21 can be used in the device shown in FIG. 18. One holding magnet 207 in the form of a stepped round disk is embedded in the rotary disk 206 per affixing head. In the present example, deformation pins 213 to 215 projecting vertically from the rotary disk are provided in each case at the same distance to the central axis of the disk and disposed in accordance with the corners of an equilateral triangle, which will be explained in greater detail by means of FIGS. 20 and 21. Of the three deformation pins, the pin 215 has an extension 216 which projects beyond the length of the pins 213 to 214. A ramp designated 218 is formed on the guide path 208 shown in FIG. 18. The ramp comprises two spaced rail elements between which the extension 216 of the deformation pin 215 is moved. A crown cap designated 217 in FIGS. 19 to 21 is carried along by the extension in the guide path and is lifted in the direction to the magnetic support 207 by the ramp 218 rising in the direction of conveyance. The pins 213 to 215 have cone surfaces tapered in the direction of the crown caps, which form a seat for the crown cap.

Figure 22:
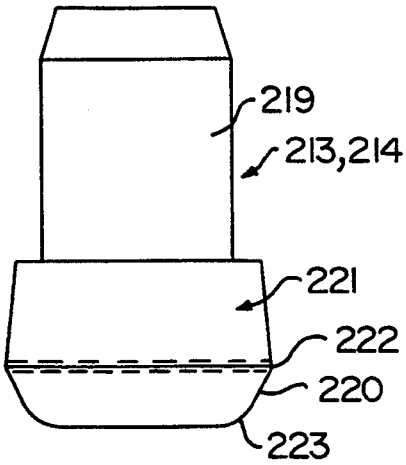
FIG. 22 shows an embodiment of a deformation pin according to the invention.

A pin as it is used for the pins 213 and 214 of the affixing head shown in FIGS. 19 and 20 is shown in FIG. 22. The pin comprises a shank 219 (not shown in FIGS. 19 and 20), via which the pin is anchored in the rotary disk 206. The deformation pin 213,214 comprises a cone surface 220 whose inclination to the pin axis is preferably about 30° and is approximately adapted to the shape or the inclination of a crown cap edge to be affixed. The pin portion 221 adjoining the cone 220 has a slightly conical tapering in the direction of the shank 219. The end edges 222 and 223 of the cone 220 are rounded.

Figure 23:
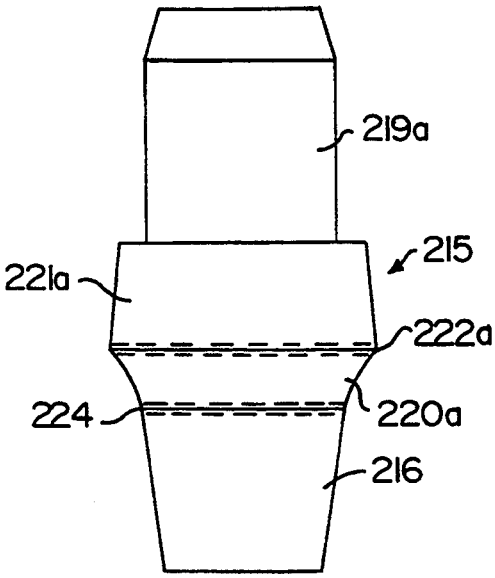
FIG. 23 shows an embodiment of a deformation pin according to the invention with an extension serving as a carrier.

The deformation pin 215 shown in FIG. 23 corresponds to the pin 213 shown in FIG. 22 with respect to the elements 219*a*, 220*a*, 221*a* and 222*a*. As opposed to the pin 213,214, the pin 215 has an extension 216, which is conically tapered to the pin end in the present embodiment. A transition edge 224 is rounded between the cone 220*a* and the extension 216.

The filled bottles being conveyed on the circular conveyor line 204 of the carousel filling means are pressed against the affixing heads of the rotary disk 206 for affixing the crown caps by means of the elevating tables 205 provided in the carousel filling means. The movement of the rotary disk 206 with the affixing head is effected synchronously to the rotation of the carousel filling means so that the affixing heads are approximately caused to coincide with the bottle openings via a small rotary angle of the rotary disk 206 or the carousel filling means so that the affixing can be carried out. Additional guide means can be provided so that the paths of the bottles and of the affixing heads are adapted to each other over a somewhat greater rotary angle. If the bottles are pressed against the affixing heads for the affixing of the crown caps by means of the elevating tables, the edge of the crown cap is bent inwardly in places as shown in FIG. 21 at the points where the deformation pins abut, whereby the bottom of the crown cap is pressed against the bottle opening with a pressing force sufficient for a slight affixing closure of the bottles by means of the binding resistance of the crown cap edge. It is advantageous for a suitable deformation of the crown caps for an affixing closure if the pin portions adjoining the crown cap cone are undercut, and are conically tapered as shown in the drawings. Due to this, removal of the bottles from the affixing heads is not prevented upon a lowering of the elevating tables 205 caused by the backspringing of the deformed crown cap edge. The removal of the bottles from the affixing heads could alternatively also be supported by the fact that a delimitation for the advance of the bottles during the affixing is provided in such fashion that the crown cap edge also abuts against a seat surface of the pin elements forming the seat with the tapered seat cross-section in the advance end position of the pin elements. The backspringing force of the deformed crown cap thus acts on an oblique plane and promotes an automatic sliding of the affixed crown caps out of the affixing heads.

In the shown embodiment the side of the magnetic support facing the crown cap is flush with the rotary disk. The magnetic disk could also be staggered rearwards or project so much that the lifting height necessary for the affixing of the crown cap is ensured. It is also conceivable that the magnetic disk can project up to the edge 222 or 222*a* of the cone 220 to 220*a* as a maximum, and the magnetic disk can be movable upwards against spring force and/or its own weight.

Directly after the affixing of the crown caps, when the bottles are again lowered to the normal transport plane, the lateral bottle guide 210 engaging into the conveyor path 204 ensures that the bottles with the affixed crown caps leave the carousel filling means and are further transported by the rotary disk 209 guided by the lateral guide 210. The movement of the rotary disk 209 is synchronized to the rotation of the carousel filling means in such fashion that the transfer of a bottle from an elevating table 205 of the carousel filling means to a pocket 209*a* of the rotary disk 209 can be effected in each case. The bottles with the affixed caps are further transported by the rotary disk 209, where they stand on sliding surfaces (not shown) until they are gripped by the lateral guide 211 and supplied to the closure means for the final closing of the bottles with the crown caps.

During the supply of crown caps to the affixing heads via the guide path 208, crown caps are supplied in radial direction, one crown cap being gripped in each case by the extension 216 of the deformation pin 215 and pushed onto the ramp 218 shown in FIG. 19. The crown cap 217 is lifted and gets into the range of action of the magnetic holding means 207, which pulls it into the seat formed by the cone surfaces 220 or 220*a* of the pins 213 to 215. Since the cone surfaces are adapted in their inclination approximately to the inclination of the crown cap edge and, moreover, the deformation pins are adapted to the shape of the crown cap edge with their roundings, an exact alignment and holding is achieved by the seat formed by the three deformation pins in the present embodiment. This alignment is necessary to achieve an exact alignment of crown cap and bottle opening if the bottle and the affixing head are superimposed for affixing the crown cap. Due to the feeding of the crown cap via the ramp and the corresponding proportioning of the magnetic force of the magnetic disk 207 it is ensured that the magnetic force is only active at the moment when the exact alignment of the crown cap in the seat formed by the cone surfaces of the deformation pins is already largely completed.

Figure 24:
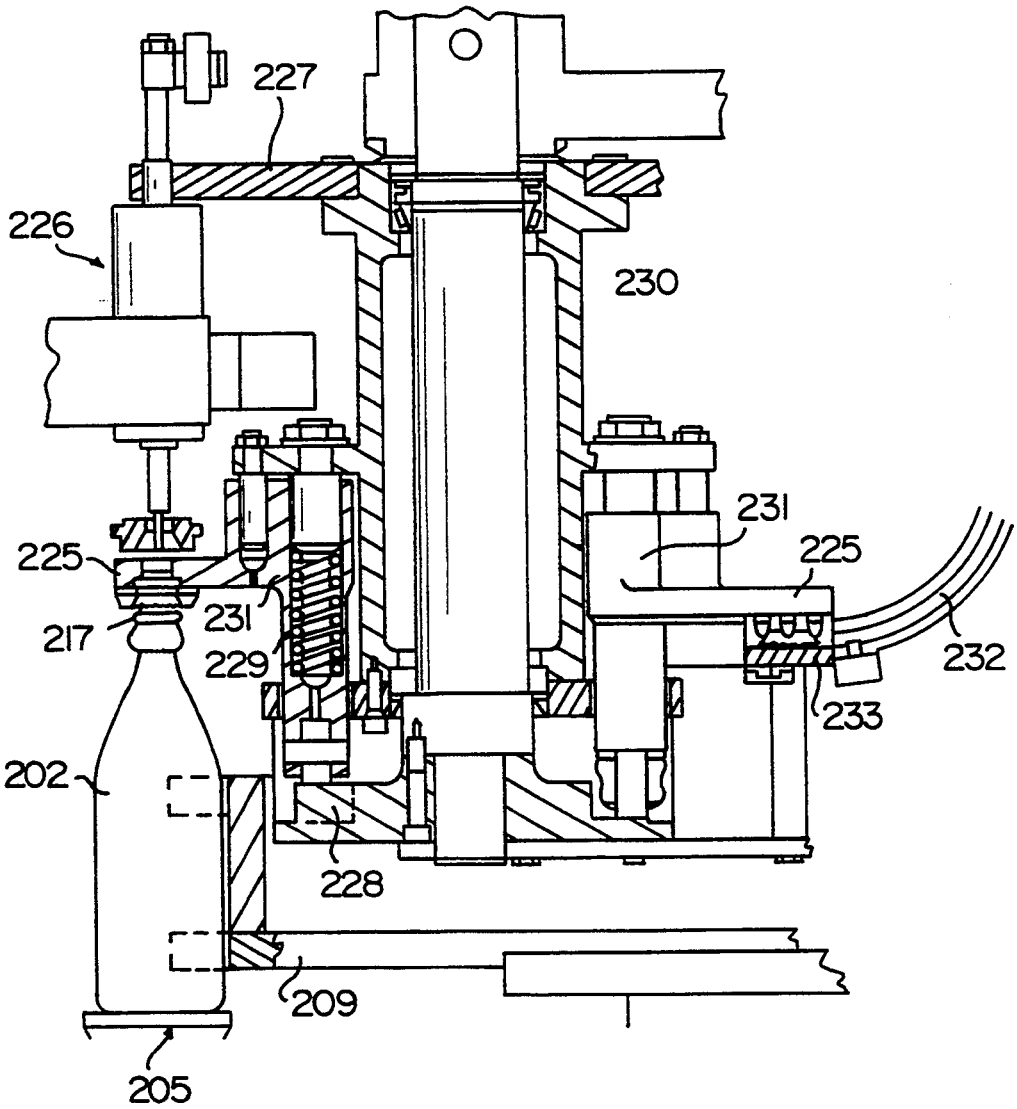
FIG. 24 shows an embodiment of an affixing means for affixing crown caps with individually movable affixing heads revolving like a carousel.

An alternative affixing means is shown in FIG. 24 which comprises affixing heads 225 revolving like a carousel, which are movable individually vertically for the affixing of the crown caps. A valve means is designated with 226 in FIG. 24 which forms part of a carousel filling means and rotates synchronously with the elevating tables 205 for a bottle 202 in the carousel filling means. A cylindrical lantern gear 227 is connected to the affixing means for synchronizing the rotary movement of the affixing means with the rotation of the carousel filling means, which gear meshes with cylindrical portions of the valve means 226. The affixing heads 225 are connected with a central rotary element 230 via a carriage means 231, the carriage means 231 being guided vertically and fixed for co-rotation on the central rotary element and displaceable upwards against the force of a spring 29. The guided carriages rest with their lower end on a stationary disk cam 228, by means of which a vertical movement of the carriages, and thus of the affixing heads, can be controlled. A lateral feeding path for the crown caps is designated 232 in FIG. 18, into which a further guide path described in greater detail in FIG. 25 ends.

The guide path designated 233 is disposed below the affixing heads 225 and adapted to the path of the affixing heads.

Figure 25:
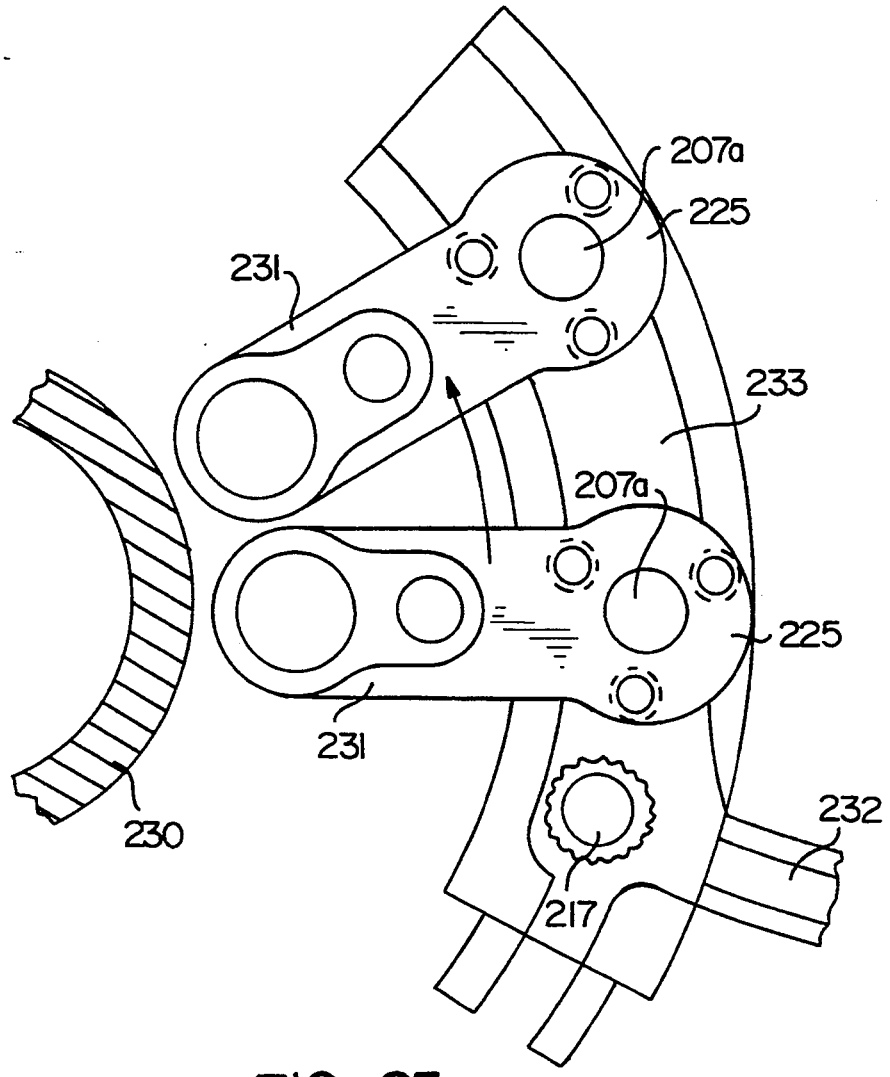
FIG. 25 is a detail of the top of the affixing means according to FIG. 24.

The affixing means shown in FIGS. 24 and 25 could be used instead of the rotary disk shown in FIG. 18. In this case, however, the affixing of the crown caps is not carried out by a lifting movement of the elevating tables 205, but by a vertical movement of the affixing heads controlled via the disk cam 228. It is ensured by means of the cylindrical lantern gear 227 that an affixing position results in each case, in which the bottles 202 and the affixing heads 225 for affixing the crown caps are aligned to each other.

In the affixing means shogun in FIGS. 24 and 25 the affixing heads are not supplied with caps via a ramp provided in the guide path 233 and an elongated deformation pin, but the affixing heads are in each case lowered down to the individual crown caps entering the guide path 233 from the guide path 232 by means of the disk cam 228.

An alignment of the crown caps in the seat formed by the cone surfaces of the deformation pins takes place during the lowering, and the magnetic supports 207*a* ensure that the crown caps remain in the seat if the affixing heads are again lifted from the guide path. In the embodiment according to FIGS. 24 and 25, a cap supply via ramps could certainly also be carried out as this was described by means of FIG. 21.

Examples of embodiment are described in the following Figs., which work with pneumatic drives for the affixing head. The fundamental construction corresponds to that already described by means of FIG. 18.

Figure 26:
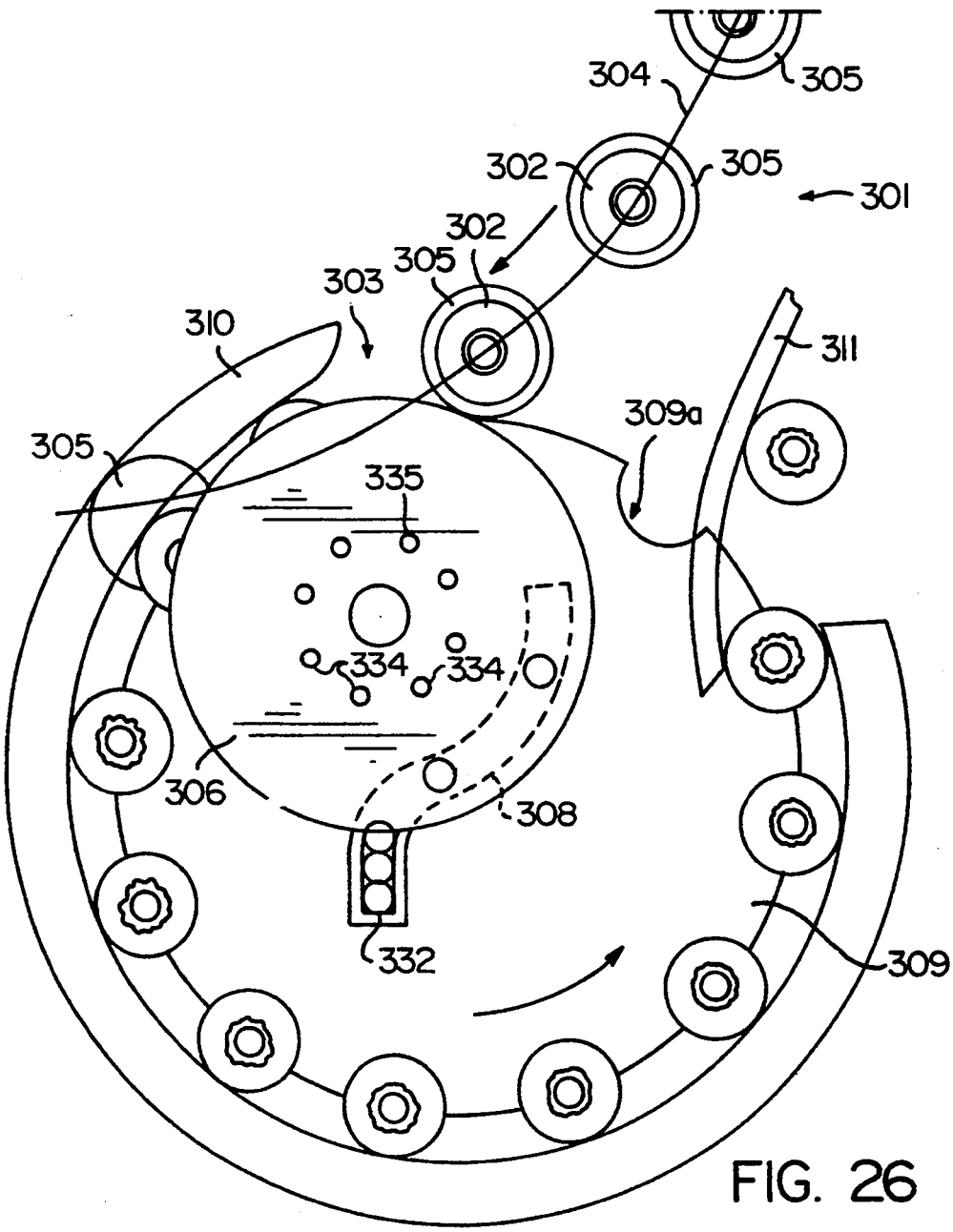
FIG. 26 shows schematically an embodiment of a device according to the invention for the filling and closing of vessels.

FIG. 26 corresponds to FIG. 18, however, additional pressure gas passage ducts designated 334 in FIG. 26, are provided in the disk cam and are in each case allocated to one of the affixing heads connected with the disk cam 306. The openings of the pressure gas passage ducts are connectable with a pressure gas source (not shown in FIG. 26) via a stationary sliding block 335 by rotating the disk cam 306, which will be explained in greater detail in the following by means of FIGS. 31 and 32.

Figure 27:
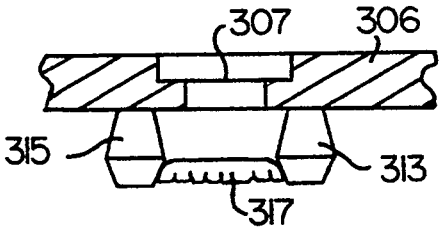
FIG. 27 is a lateral view of an embodiment of an affixing head.
Figure 28:
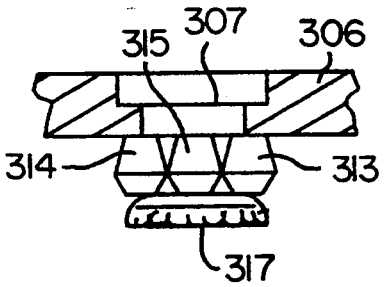
FIG. 28 is a rear view of the head of FIG. 27.
Figure 29:
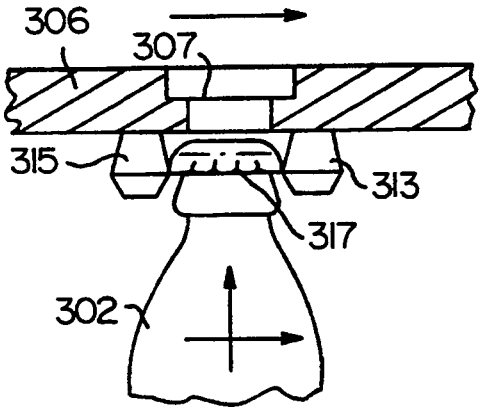
FIG. 29 is a lateral view of the head of FIGS. 27 and 28 during the affixing of a crown cap.

An affixing head is shown in FIGS. 27 to 28 that can be used in the device shown in FIG. 26. A holding magnet 307 in the form of a stepped round disk is embedded in an affixing head carrier plate 306. Deformation pins 313 to 315 projecting vertically from the affixing head carrier plate are disposed in the present embodiment in each case at the same distance to the central axis of the disk and in accordance with the corners of an equilateral triangle. They are shown in greater detail in FIG. 30. A crown cap designated 317 in FIGS. 27 to 28 is supplied to the affixing head via the guide path 308 shown in FIG. 26, the affixing heads being e.g. lowered so much into the guide path that the crown caps get into the range of action of the holding magnets 307. The pins 313 to 315 have cone ends tapering in the direction of the crown cap, which form a seat for the crown cap.

Figure 30:
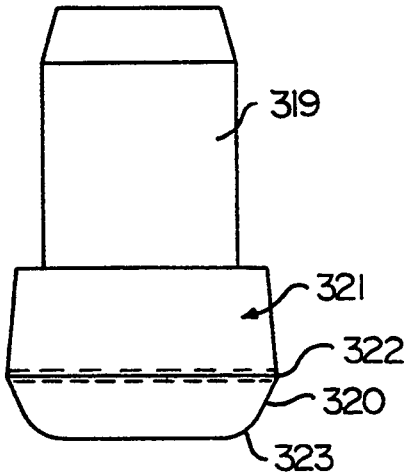
FIG. 30 shows an embodiment of a deformation pin.

A pin used as the pins 313 to 315 of the affixing head shown in FIGS. 27 and 28 is shown in detail in FIG. 30. The pin has a shank 319 (in each case not shown in FIGS. 27 to 28), via which the pin can be anchored in the affixing head carrier plate 306. The deformation pin has a cone surface 320 whose inclination to the pin axis is preferably approximately 30° and which is approximately adapted to the shape or inclination of a crown cap edge to be affixed. The pin portion 321 adjoining the cone 320 has a slight conical taper in the direction of the shank 319. The end edges 322 and 323 of the cone 320 are rounded.

Figure 31:
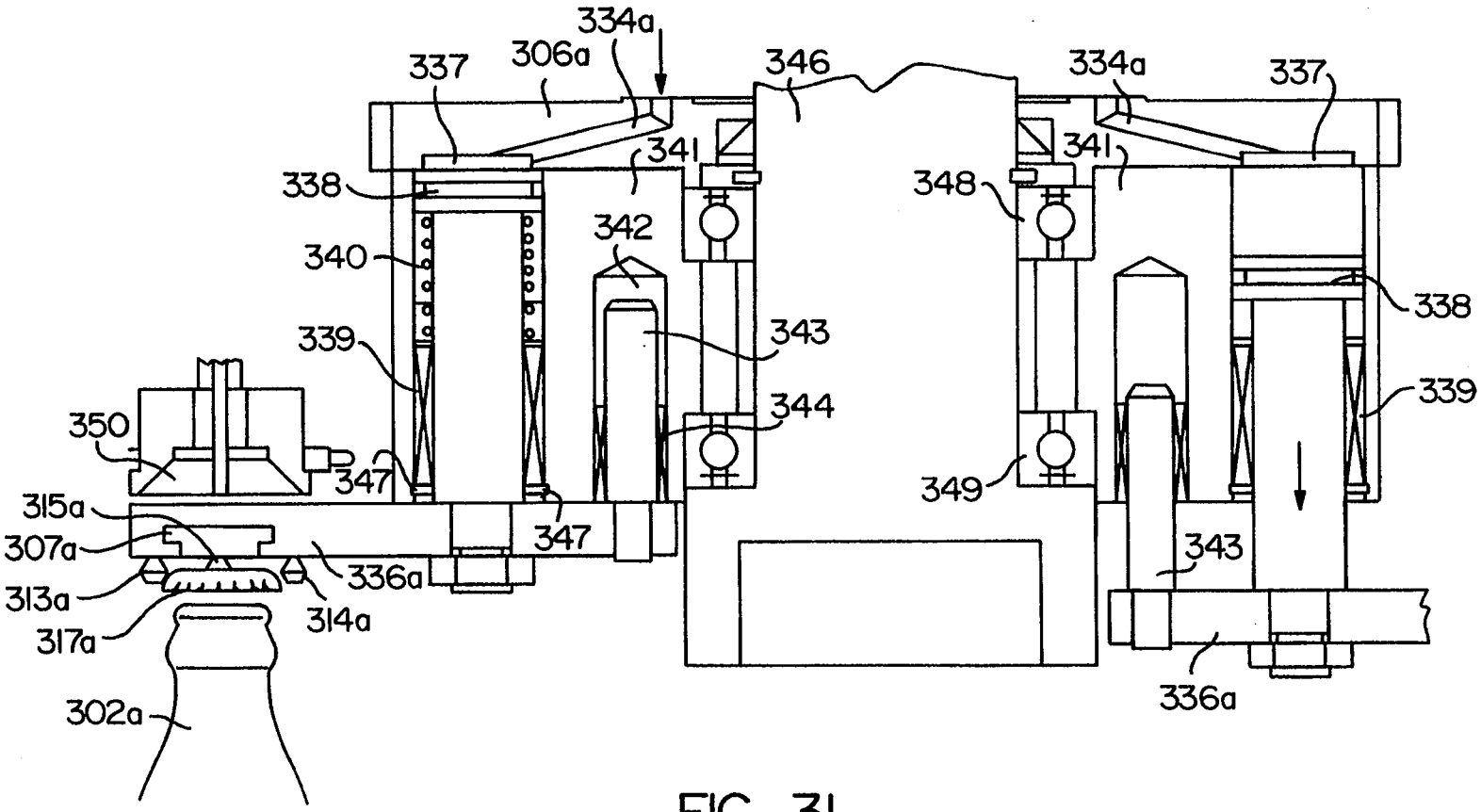
FIG. 31 shows an embodiment of an affixing means according to the invention as it can be used in a device according to the invention for the filling and closing of vessels according to FIG. 26.

A disk cam 306a with passage ducts 334a is shown in FIG. 31. Several pressure cylinders 337 in accordance with the number of passage ducts 334a are provided on the lower side of the disk cam 306a, which are disposed on a circular circumference, the passage ducts 334a being open towards the interior of the compressed-air cylinders. One piston 338 each is guided in the compressed-air cylinders, which is connected in each case with an affixing head carrier plate 336a. Deformation pins connected with the carrier plate 336a and forming the affixing head are designated with 313a to 315a, and a magnetic plate 307a is embedded into the carrier plate. The piston rod of the piston 338 is guided in a guide sleeve 339 provided in the cylinder 337 and fastened by means of a ring 347. The piston 338 can be moved against a helical spring 340, which rests with one end against the edge of the piston 338, which projects beyond the piston rod, and with its other end against the edge of the guide sleeve 339, which faces the piston. The cylinders 337 are in each case provided as recesses in blocks 341 connected with the disk cam 306a in pressure-sealed fashion. A guide pin 343 connected with the affixing head carrier plate is in each case guided in a further recess 342 in the blocks 341 via a guide sleeve 344.

A central carrier element designated 346 is provided on which the disk cam with the affixing heads connected to it is rotatably mounted via bearings 348 and 349.

A filling bell of a valve means is designated with the reference numeral 350 in FIG. 31, which co-rotates synchronously with bottles 302a in the carousel filling means, which are deposited on elevating tables (not shown in FIG. 31) for lifting the bottles against the filling bell.

Figure 32:
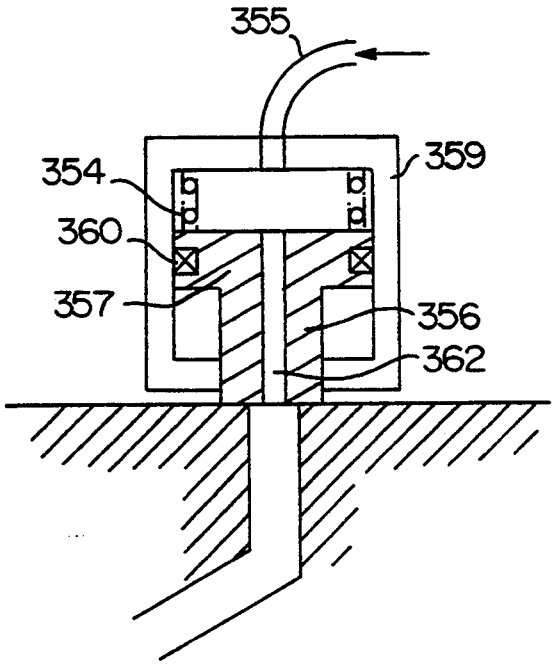
FIG. 32 shows an embodiment of a sliding block usable in the affixing means according to the invention of FIG. 1 for the supply of compressed air.

A feeding means (not shown in FIG. 31) held stationarily and horizontally on the disk cam 306a for the feeding of compressed air is shown in FIG. 32. The means comprises a cylinder 359 which is disposed fixed for co-rotation with respect to the disk cam 306a, in which a piston 357 with a sealing ring 360 is guided. The piston 357 is connected with a piston rod which is designed as a sliding block 356 supported on the disk cam 306a. The piston 357 and the sliding block 356 connected with it are provided with a bore 362 which opens at one end to the interior of the cylinder 359 and at the other end to the sealing slide surface, on which the sliding block 356 rests against the disk cam 306a. A feed line designated 355 is provided, via which the interior of cylinder 359 can be connected with a compressed-air source (not shown in FIG. 32). The wall of the cylinder 359 is designed in such fashion at the cylinder end facing the disk cam 306a that a guiding of the sliding block 356 is ensured. A helical spring 354 is disposed in the interior of the cylinder which rests with one end against the piston 357 and with the other end against the front wall of the cylinder 359.

A condition is represented in FIG. 32, in which the disk cam 306a is disposed in such fashion with respect to the feeding means that the passage opening 334a is in communication with the bore 362. The disk cam 306a with the affixing heads moves synchronously with the carousel filling means in such fashion that the affixing heads for affixing the crown caps are in each case aligned over the conveyed, just filled bottles, the affixing heads engaging into the interspace between the filling bell 350 and the bottles 302a lowered with respect to the filling bell. The compressed-air feed means is disposed on the disk cam 306a in such fashion that a passage duct 334a is in each case in communication with the bore 362 when the affixing head with the crown cap 317a supplied previously to it has arrived above a bottle to which the crown cap is to be affixed. Since compressed air can enter the cylinder 337 via the respective passage ducts 334a, the piston and the affixing head connected thereto are moved in a direction vertically to the longitudinal axis of the bottle, and the crown cap is affixed to the bottle 302a by this movement. Due to the additional guide of the affixing head carrier plate 336a via the pin 343 torques are absorbed which occur due to the fact that the affixing head is disposed in staggered relationship with respect to the piston 338 in a horizontal direction. In the case of a further rotation of the disk cam 306a, the connection between the bore 362 and the passage duct 334a is interrupted again and the piston 338 is pressed upwards by the helical spring 340 so that the affixing head is lifted from the bottles with the crown cap having been affixed in the meantime. After the affixing, the bottles 302a are transferred by the rotary disk 309 shown in FIG. 26 to the means for the final closing of the bottles. In order to receive the crown caps supplied on the guide path 308, the affixing heads, controlled by a cam path (not shown in FIG. 31) against the force of the spring 340 to the guide path 308, are lowered to the guide path 308 so that the crown caps get into the range of action of the magnetic disk 307a and are thus pulled into the seat formed by the guide pins. An affixing head is shown in such a lowered position on the righthand side of FIG. 31. The crown cap supply to the affixing heads could also be carried out via a ramp on the guide path 308 as described above.

The cross-sections of the bore 362 and of the passage ducts 334 are designed in such fashion that the time sequence of the piston movement and the pressing pressure development during the available closing time, i.e. the time during which the affixing heads and bottles revolving on different paths are aligned exactly to each other in a fashion suited for affixing, a reliable affixing of the crown caps is ensured. The acting of pressure on the pistons 338 is carried out during the time in which the bore 362 is in communication with the respective passage duct 334a.

Shape and dimensions of the cross-sectional surfaces of the passage ducts 334a and the bore 362 can be suitably dimensioned in such fashion at least at their end openings facing each other that a specific, desired chronological coordination of the advance movement and the pressing pressure development of the affixing heads is achieved.

It is ensured by the auxiliary spring 354 that a sufficient pressing pressure is present between the sliding block and the disk cam, even if a pressure drop occurs in the interior of the cylinder when the opening ends of the bore 362 and a respective passage duct 334a overlap.

I claim:

1. In a process for the filling of vessels having a filling neck in a filling device and for closing the filled vessels with closure elements, wherein said closure elements are deformed around the necks of the vessels to form a sealed press fit between the closure elements and the vessels, the improvement comprising first affixing the closure elements to the vessels in a first closing phase immediately after the vessels have been filled and while they are still in the area of the filling device with a pressure sufficient to form only a slight press fit between the closure elements and the vessels to prevent the closure elements from falling off the vessels and thereafter transporting the vessels with the closure elements affixed thereto to a second closing phase for the sealing of the closure elements to the vessels with a final closing pressure sufficient to form said sealed press fit between the closure elements and the vessels.

2. The process of claim 1, wherein the slight press fit in the first closing phase is produced by applying to each closure element a pressure-application force of about 20 kp.

3. The process of claim 2, wherein the sealed press fit in the second closing phase is produced by applying the final closing pressure to each closure element with a pressure-application force of about 80 kp.

4. The process of claim 1, wherein each closure element is preshaped so as to engage the neck of each vessel with a snap fit when the element is affixed thereto to thereby form said slight press fit in said first closing phase.

5. The process of claim 1, wherein each closure element is plastically deformed during the first closing phase to form said slight press fit.

6. The process of claim 1, wherein said closure elements are crown caps.

7. The process of claim 6, wherein each said crown cap has a crown edge that is flanged at least in places to narrow the inner diameter of the crown cap to such an extent that the crown cap can snap fit on the neck of the vessel when it is affixed thereto in said first closing phase.

8. The process of claim 7, including inwardly projecting detents on the crown edge of the crown cap so that the crown cap can snap fit on the neck of the vessel when it is affixed thereto in said first closing phase.

9. The process of claim 6, wherein each said crown cap is flanged during the first closing phase to form said slight press fit.

10. The process of claim 7, wherein the crown edge of the crown cap is flanged in places during the first closing phase.

11. The process of claim 10, wherein the crown edge of the crown cap is flanged at two diametrically opposite points.

12. The process of claim 4, wherein each closure element has a projecting central lug that fits in the neck of the vessel to be closed with a snap fit to form said slight press fit between the closure element and the vessel in said first closing phase.

13. In a device for the filling of vessels having a filling neck in a filling device and for closing the filled vessels with closure elements in a closing device, wherein said closure elements are deformed around the necks of the vessels in the closing device by closing means to form a sealed press fit between the closure elements and the vessels, the improvement comprising affixing means in the filling device for affixing the closure elements to the vessels immediately after the vessels have been filled and while they are still in the area of the filling device with a pressure sufficient to form only a slight press fit between the closure elements and the vessels to prevent the closure elements from falling off of the vessels and transport means for thereafter transporting said vessels with the closure elements affixed thereto to said closing device for closing by the closing means applying a final closing pressure to said closure elements sufficient to form said sealed press fit between the closure elements and the vessels.

14. The device of claim 13, wherein the transport means for the transport of the vessels from the affixing means of the filling device to the closing device is located between a vessel outlet of the filling device and the closing device.

15. The device of claim 14, wherein the transport means comprises a rotary transport disk that transports the vessels on a circular transport path.

16. The device of claim 15, wherein the filling device is a carousel filling device.

17. The device of claim 16, wherein affixing means is located at a vessel outlet of the filling device.

18. The device of claim 17, wherein the affixing means includes a rotary disk having supports thereon for holding the closure elements around the circumference of the disk before being affixed to the vessels.

19. The device of claim 18, wherein the supports are magnetic supports.

20. The device of claim 17, including a feed means for feeding closure elements to the affixing means, the affixing means including a deformation means for deforming the closure elements to form said slight press fit.

21. The device of claim 18, wherein the vessels are located on delivery tables movable relative to a filling valve in the filling device.

22. The device of claim 21, wherein the closure elements are affixed to the vessels by the delivery tables pressing the vessels thereon against a closure element held in a support on the rotary disk.

23. The device of claim 22, wherein the supports include deformation means for deforming the closure elements while they are supported on the rotary disk.

24. The device of claim 23, wherein the closure element is a crown cap having a flanged crown edge and the deformation means comprise projecting pins for flanging the crown edge of the crown cap in places so that when the crown cap is affixed to the vessel it will form said slight press fit of the crown cap with the vessel.

25. The device of claim 24, wherein the deformation means include an affixing head having at least three projecting pin elements each having on their end faces a surface that tapers substantially in accordance with the flanged shape of the edge of the crown cap for deforming and for aligning the crown cap with and for affixing the crown cap to the neck of the vessel.

26. The device of claim 25, wherein the pin elements have beveled surfaces corresponding substantially to the inclination of the crown cap edge of the crown caps.

27. The device of claim 26, wherein the pin elements have a cone surface adapted substantially to the inclination of the crown cap edge.

28. The device of claim 25 having three pin elements.

29. The device of claim 28, wherein the pin elements are disposed approximately to form an equilateral triangle.

30. The device of claim 26, wherein the beveled surfaces have an inclination of about 30° with the pin axis.

31. The device of claim 27, wherein the pin elements are round pins with a cone surface.

32. The device of claim 31, wherein the pins are undercut at their portion adjoining the maximum cone cross-section.

33. The device of claim 32, wherein the pins taper conically at their portion adjoining the maximum cone cross-section.

34. The device of claim 32, wherein the surface of the cone has rounded end edges.

35. The device of claim 25, wherein the affixing heads revolved in a circle.

36. The device of claim 35, wherein the affixing heads are disposed on a rotary disk.

37. The device of claim 36, including means for synchronizing the revolution of the affixing heads on the rotary disk with the rotation of the carousel filling device.

38. The device of claim 37, wherein the vessels are pressed against an affixing head for the affixing of the crown cap by movement of the delivery tables.

39. The device of claims 38, including guide means for feeding the crown caps to the affixing heads from below the revolving affixing heads on the rotary disk.

40. The device of claim 39, wherein one of said pins has an extension projecting beyond the tapered end acting as pusher for pushing the crown cap along the guide path.

41. The device of claim 40, including a ramp in the guide path for lifting a crown cap into the attraction area of a holding magnet provided on the affixing head, the ramp having two spaced ramp rails between which said extension of the one pin passes.

42. The device of claim 25, wherein the crown caps are pressed against the vessel by movement of the affixing heads.

43. The device of claim 42, wherein the affixing heads are individually movable for the affixing of the crown caps.

44. The device of claim 25, wherein the magnetic support comprises a magnetic plate movable in the direction of the pin axes against a spring.

45. The device of claim 25, wherein the affixing means for affixing a crown cap includes a pneumatic driving means for advancing an affixing head toward the vessel.

46. The device of claim 45, including a reversing spring for reversing movement of the head against the direction of its advancement by the driving means.

47. The device of claim 45, wherein the driving means comprises at least one pressure cylinder with a piston guided therein.

48. The device of claim 47, wherein the affixing head is connected to the piston.

49. The device of claim 45, wherein the affixing heads revolve in a circle.

50. The device of claim 49, wherein a pressure cylinder with a piston is associated with each of the revolving affixing heads.

51. The device of claim 50, wherein the pressure cylinders associated with the revolving affixing heads are connected with a disk cam comprising passage ducts connectable to a source of pressurized gas for operating the cylinders.

52. The device of claim 51, wherein the passage ducts are connectable to the pressurized source of gas via a sliding block with a pressure gas supply duct ending in a sealing slide surface resting against the disk cam, whose opening end facing the disk cam can be covered by the disk cam and which is connectable with the control passage duct by means of a rotation of the disk cam.

53. The device of claim 52, wherein the cross-sectional surface of each passage duct and the cross-sectional surface of the pressure gas supply duct are at least dimensioned at their opening ends facing each other for the time control of the affixing process.

54. The device of claim 52, wherein the cross-sectional surface of the pressure gas supply duct is at least smaller at its opening ends facing each other than the cross-sectional surface of each passage duct.

55. The device of claim 52, wherein the sliding block is connected with a piston guided in a pressure cylinder connected to the pressurized gas source for producing a sealing pressure between the sealing slide surface and the disk cam.

* * * * *